United States Patent [19]

Syred et al.

[11] 4,249,575

[45] Feb. 10, 1981

[54] FLUIDIC DEVICES

[75] Inventors: Nicholas Syred; Peter J. Roberts, both of Cardiff, Wales

[73] Assignee: United Kingdom Atomic Energy Authority, London, England

[21] Appl. No.: 29,103

[22] Filed: Apr. 11, 1979

[30] Foreign Application Priority Data

May 11, 1978 [GB] United Kingdom ..... 19049/78

[51] Int. Cl.[3] ..... F15C 1/16

[52] U.S. Cl. ..... 137/812

[58] Field of Search ..... 137/808, 809, 811, 812, 137/813

[56] References Cited

U.S. PATENT DOCUMENTS 3,276,259 10/1966 Bowles et al. ..... 137/813 X 4,003,405 1/1977 Hayes et al. ..... 137/813

4,112,977 9/1978 Syred et al. ..... 137/812

OTHER PUBLICATIONS

Jacobs, B.E.A., "Fluidic Diodes", B.H.R.A. Fluid Engineering, 1973.

*Primary Examiner*—William R. Cline

*Attorney, Agent, or Firm*—Larson, Taylor and Hinds

[57] ABSTRACT

A vortex diode has a cylindrical vortex chamber having an enlarged peripheral channel, one or more tangential ports communicating with the channel and two co-axially arranged axial ports on opposite end walls of the chamber. The height of the chamber is less than three quarters of the diameter of the axial ports. The channel may communicate with the vortex chamber either radially or tangentially with respect to the channel.

6 Claims, 3 Drawing Figures

FLUIDIC DEVICES

BACKGROUND OF THE INVENTION

This invention relates to fluidic devices, in particular to devices in which fluid flow can be controlled by producing a vortex in the fluid so as to present a higher resistance to flow in one direction than in the other. Such devices are termed vortex diodes.

A known form of vortex diode comprises a thin cylindrical chamber having a tangential port in the peripheral wall thereof and an axial port in an end wall thereof, the fluid entering and leaving the device through these ports. There are two modes of operation. If the fluid flow enters through the axial port and exits through the tangential port no appreciable vortex is formed and the resistance to flow is relatively small. However, if the flow enters through the tangential port and exits through the axial port a vortex is formed within the chamber and the resistance to flow is relatively high. These two modes of operation are herein termed low and high resistance modes respectively.

SUMMARY OF THE INVENTION

According to the present invention a vortex diode comprises a cylindrical vortex chamber as hereinafter defined having an enlarged peripheral channel, at least one tangential port leading into the peripheral channel, which has a diameter which is substantially equal to the diameter of the or each tangential port and two co-axially aligned axial ports extending from opposite end walls of the chamber, the height of the cylindrical vortex chamber being less than 0.75 times the diameter of each axial port. Such a cylindrical vortex chamber is hereinafter referred to as a thin cylindrical vortex chamber. In use of the vortex diode in the high resistance mode the fluid flow out of the chamber takes place through both of the axial ports.

Any number of tangential ports may be provided. However in a preferred embodiment only one port is present. The enlarged peripheral channel may communicate with the thin cylindrical vortex chamber radially with respect to the channel but it is preferred if the channel communicates with the chamber tangentially with respect to the channel. The tangentially-connected channel induces a weak vortical motion in the fluid in the channel and this enables the diffuser angle of the duct leading to the tangential port to be increased and hence the length of the diffuser section of this tangential duct to be made shorter. In known vortex diodes the tangential diffuser angle has been made 7° so as to minimise the resistance to flow in the low resistance state. With the channel connected tangentially the diffuser angle may be increased to 10°.

DESCRIPTION OF THE DRAWINGS

The invention will be illustrated by the following description of two embodiments of vortex diode. The description is given by way of example only and has reference to the accompanying drawings in which.

DESCRIPTION OF THE PREFERRED EMBODIMENTS

Figure 1:
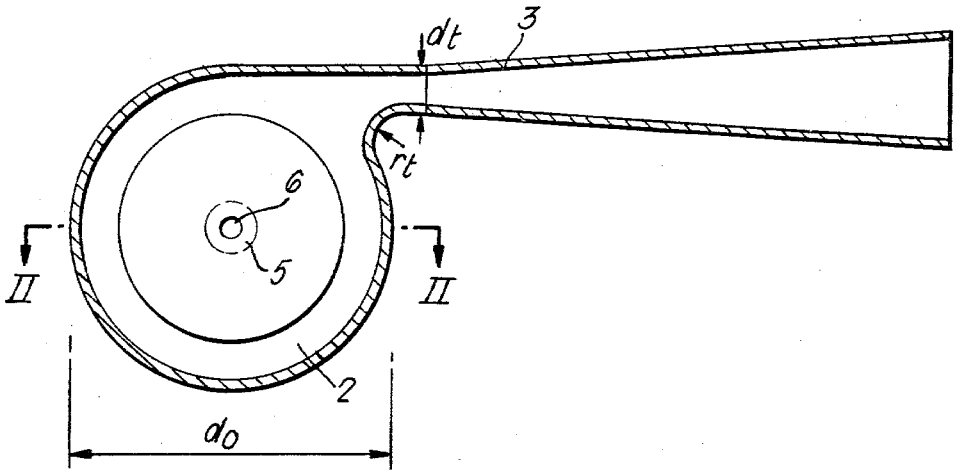
FIG. 1 is a cross-sectional view of a vortex diode.
Figure 2:
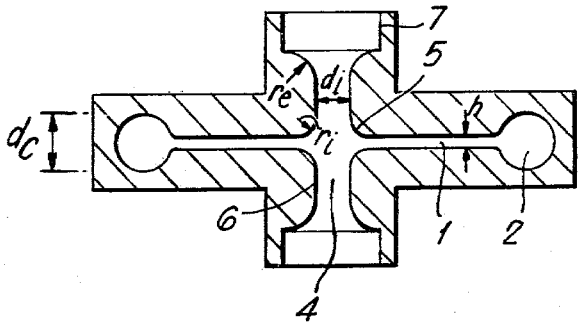
FIG. 2 is a section along the line II—II in FIG. 1.

FIGS. 1 and 2 show a vortex diode having a thin cylindrical vortex chamber 1 having an enlarged channel 2 around the periphery of the chamber 1 and connected thereto. A single tangential port 3 having a diameter equal to the diameter of the peripheral channel 2 communicates with the channel 2. Two co-axially aligned axial ports 4 extend from the centre of the vortex chamber. The axial ports merge with the vortex chamber in smooth curved surfaces 5 which lead to cylindrical sections 6 of the axial ports 4. At the ends of the cylindrical sections 6 the axial ports open out to the diameter of the flow passages 7 communicating therewith. The cylindrical sections 6 may be replaced by frusto-conically tapering sections (not shown) which have the larger diameter adjacent the vortex chamber 1.

When operating in its low resistance mode flow enters the chamber 1 through the axial ports 4 and exhausts through the tangential port 3. The flow diffuses radially outwardly from the axial ports 4 in the vortex chamber in a substantially uniform pattern and enters the channel 2 about the periphery of the chamber and passes into the tangential port 3 which forms a conical diffuser to recover the pressure energy in the low resistance mode. In this mode the vortex chamber acts as a radial diffuser to the flow which enters through the two axial ports 4. The tangential port may be formed as an insert having a push-fit in the main body of the diode and may be cemented or bonded in position. Alternatively, the tangential port can be formed by drilling in the body of the diode. The diameter of the channel 2 is substantially equal to diameter of the tangential port 3 at its region of merger with the vortex chamber.

For optimum performance of the vortex diode in both the high and low resistance modes of operation careful attention should be given to the geometry of the diode and the relationships of particular parameters. These parameters will be denoted by the following symbols which are shown in the drawings.

- h—height of vortex chamber 1
- $d_o$—overall diameter of the chamber 1
- $d_i$—diameter of the cylindrical portions 6 of the axial ports 4
- $r_i$—radius of curvature at the junction between axial ports 4 and the vortex chamber
- $r_e$—radius of curvature at the junction of the cylindrical section 6 of the axial ports 4 with the flow passage 7 communicating therewith
- $d_t$—diameter of tangential port 3 at its region of merger with the peripheral channel
- $r_t$—radius of curvature at the junction of the or each tangential port 3 with the peripheral channel
- $d_c$—diameter of the peripheral channel 2

The relationship between h and $d_i$ is preferably such that $h/d_i$ ranges from 0.1 to 0.5 and the ratio $d_o/d_i$ can range from 8 to 20. Preferably, $h/d_i$ is about 0.3 and $d_o/d_i$ is about 12 to give maximum resistance in the high resistance mode of operation.

To prevent flow separation at the junction of the axial ports and the chamber it is desirable that $r_i$ should be greater than 0.3 $d_i$ and not greater than 3 $d_i$. Conveniently, $r_i$ can be 0.39 $d_i$ to prevent flow separation at the junction in the low resistance mode of operation. Further $r_e$ should preferably lie within the range 0.3 $d_i$ to 4 $d_i$.

The total cross-sectional area $A_i$ of the axial ports ($\pi d_i^2/2$) and the total cross-sectional area $A_t$ of the tangential port or ports ($n\pi d_t^2/4$) where n is the number of tangential ports, should be such that $A_t/A_i$ is within the range 0.5 to 2.2. Conveniently the ratio $A_t/A_i$ can be within the range 1.1 to 1.7.

Pressure loss at the tangential port is influenced by the relationship between $r_t$ and $d_t$. If the ratio $r_t/d_t$ is small then a considerably pressure loss can be experienced. Alternatively an increase in the ratio $r_t/d_t$ will reduce the pressure loss in the low resistance mode but adversely affects the performance in the high resistance mode of operation. Conveniently the ratio $r_t/d_t$ can be in the range 0.5 to 2 and preferably the ratio should approach 1. A ratio $r_t/d_t$ within the range 0.9 to 1.1 results in a favourable compromise between low resistance in the low resistance mode and a high resistance in the high resistance mode of operation. The length of each tangential port is preferably such that the diameter at the end thereof remote from the vortex chamber is at least 2 $d_t$.

The ratio of the height of the chamber 1 (h) to the diameter of the channel 2 ($^dc$) is preferably greater than 0.2 if an increase in flow resistance in the low resistance mode is not to occur.

Figure 3:
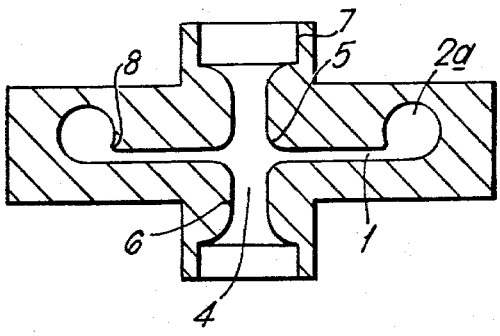
FIG. 3 is a cross-sectional view of a second vortex diode.

In the vortex diode shown in FIG. 3 the thin vortex chamber 1 communicates with a peripheral channel 2*a* tangentially with respect to the channel. This causes the fluid flow in the channel to have a weak vortical flow which enables the tangential diffuser angle to be made larger and angles of up to 10° may be used. Thus the length of diffuser required to achieve a diameter of 2 $d_t$ is reduced compared to that of the diode shown in FIGS. 1 and 2 wherein the diffuser angle is 7°.

The edge 8 produced where the vortex chamber 1 merges tangentially with the channel 2*a* preferably has a radius which is in the range 0.1 to 0.2 of the channel diameter.

We claim:

1. In a vortex diode comprising a cylindrical vortex chamber having an enlarged peripheral channel, at least one tangential port leading into the peripheral channel, an axial port, and geometric parameters as follows:

(a) the diameter of the or each tangential port ($d_t$) at the region of merger with the peripheral channel is substantially equal to the diameter of the channel, (b) the ratio of the radius of curvature at the junction of the or each tangential port with the peripheral channel ($r_t$) and the diameter of the or each tangential port ($d_t$) is such that $r_t/d_t$ is in the range 0.5 to 2, (c) the ratio of the radius of curvature at the junction between the axial port and the vortex chamber ($r_i$) and the diameter of said port ($d_i$) is such that $r_i/d_i$ is in the range 0.3 to 3, (d) the ratio of the radius of curvature at the junction of the axial port with a flow passage remote from the vortex chamber ($r_e$) and the diameter of the axial port ($d_i$) is such that $r_e/d_i$ is in the range 0.3 to 4, (e) the ratio of the total cross sectional areas of the tangential and axial ports ($A_t$ and $A_i$ respectively) is such that $A_t/A_i$ is in the range 0.5 to 2, the improvement which comprises a second axial port so arranged that the two such ports are in axial alignment extending oppositely away from the vortex chamber and are alike in size and geometric parameters, the height of the cylindrical vortex chamber (h) being less than 0.75 times the axial port diameter ($d_i$), and the ratio of the overall diameter of the vortex chamber ($d_o$) and the axial port diameter ($d_i$) being such that $d_o/d_i$ is in the range 8 to 20.

2. A vortex diode as claimed in claim 1 wherein the peripheral channel communicates with the chamber radially.

3. A vortex diode as claimed in claim 1 wherein the peripheral channel communicates with the chamber tangentially with respect to the channel.

4. A vortex diode as claimed in claim 3 in which the tangential diffuser angle is 10°.

5. A vortex diode as claimed in claim 3 in which the radius of curvature of the edge produced where the peripheral channel merges tangentially with the chamber is in the range 0.1 to 0.2 times the channel diameter.

6. A vortex diode as claimed in claim 1 wherein the ratio of the height of the vortex chamber (h) to the diameter of the peripheral channel ($d_c$) is such that $h/d_c$ is greater than 0.2.

* * * * *